US011987920B2

(12) United States Patent
Mashal

(10) Patent No.: US 11,987,920 B2
(45) Date of Patent: May 21, 2024

(54) SYSTEM AND METHOD FOR REMOTE MONITORING AND CONTROL OF A LAUNDRY APPLIANCE

(71) Applicant: Haier US Appliance Solutions, Inc., Wilmington, DE (US)

(72) Inventor: Khalid Jamal Mashal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 742 days.

(21) Appl. No.: 17/095,162

(22) Filed: Nov. 11, 2020

(65) Prior Publication Data

US 2022/0145511 A1 May 12, 2022

(51) Int. Cl.

| | |
|---|---|
| ***D06F 34/05*** | (2020.01) |
| ***D06F 34/18*** | (2020.01) |
| ***D06F 34/28*** | (2020.01) |
| ***D06F 39/14*** | (2006.01) |
| ***D06F 58/04*** | (2006.01) |
| ***D06F 58/34*** | (2020.01) |
| *D06F 101/20* | (2020.01) |
| *D06F 103/06* | (2020.01) |
| *D06F 105/02* | (2020.01) |

(Continued)

(52) U.S. Cl.

CPC ..... *D06F 34/05* (2020.02); *D06F 34/18* (2020.02); *D06F 34/28* (2020.02); *D06F 39/14* (2013.01); *D06F 58/04* (2013.01); *D06F 58/34* (2020.02); *D06F 2101/20* (2020.02); *D06F 2103/06* (2020.02); *D06F 2105/02* (2020.02); *D06F 2105/10* (2020.02); *D06F 2105/20* (2020.02); *D06F 2105/44* (2020.02); *D06F 2105/48* (2020.02); *D06F 2105/50* (2020.02); *D06F 2105/52* (2020.02)

(58) Field of Classification Search

CPC ..... D06F 34/05; D06F 34/18; D06F 34/28; D06F 58/34; D06F 58/04; D06F 39/14; D06F 2105/48; D06F 2105/10; D06F 2105/50; D06F 2105/44; D06F 2105/20; D06F 2105/52; D06F 2105/02; D06F 2103/06; D06F 2101/20

USPC ..... 68/12.02

See application file for complete search history.

(56) References Cited

U.S. PATENT DOCUMENTS

2015/0000195 A1* 1/2015 Choi ..... D06F 34/20 49/13
2017/0116986 A1* 4/2017 Weng ..... G10L 13/033

(Continued)

FOREIGN PATENT DOCUMENTS

CN 109402941 A 3/2019
CN 110512396 A 11/2019

*Primary Examiner* — Tinsae B Ayalew
(74) *Attorney, Agent, or Firm* — Dority & Manning, P.A.

(57) ABSTRACT

A laundry appliance, such as a washing machine or dryer appliance, includes a basket that is rotatably mounted within a tub and that defines a chamber for receiving a load of clothes. A camera assembly is mounted within the tub for taking images of the load of clothes and a controller is operably coupled to the camera assembly for determining that a limited access mode is activated, receiving a start command for an operating cycle, obtaining and transmitting images or a live stream of the chamber to a remote device, and receiving user input related to a responsive action, such as a cycle authorization or operating parameter adjustment.

20 Claims, 6 Drawing Sheets

(51) Int. Cl.

| | |
|---|---|
| *D06F 105/10* | (2020.01) |
| *D06F 105/20* | (2020.01) |
| *D06F 105/44* | (2020.01) |
| *D06F 105/48* | (2020.01) |
| *D06F 105/50* | (2020.01) |
| *D06F 105/52* | (2020.01) |

(56) References Cited

U.S. PATENT DOCUMENTS

| | | | | |
|---|---|---|---|---|
| 2019/0264372 | A1* | 8/2019 | Kessler | G01J 3/513 |
| 2020/0071871 | A1* | 3/2020 | Kim | G06V 10/82 |

* cited by examiner

SYSTEM AND METHOD FOR REMOTE MONITORING AND CONTROL OF A LAUNDRY APPLIANCE

FIELD OF THE INVENTION

The present subject matter relates generally to laundry appliances, or more specifically, to systems and methods for using a camera assembly to facilitate remote monitoring and control of laundry appliances.

BACKGROUND OF THE INVENTION

Laundry appliances, such as washing machine appliances and dryer appliances, are commonly used to wash and dry, respectively, a load of clothes. Specifically, washing machine appliances generally include a wash tub for containing water or wash fluid and a wash basket rotatably mounted within the wash tub for receiving the load of clothes. These washing machines are typically equipped to operate in one or more modes or cycles, such as wash, rinse, and spin cycles. After the washing machine processes are complete, the load of clothes is moved over the to the dryer, which includes a cabinet with a drum rotatably mounted therein and a heating assembly that supplies heated air into a chamber of the drum, e.g., through a duct mounted to a back wall of the drum, to facilitate a drying process.

Notably, however, the efficacy of operating cycles in laundry appliances depends in large part on characteristics of the added load, user inputs, cycle selections and parameters, and other user-dependent variables. Moreover, incorrect cycle settings or improper load type or preparation may result in damaged clothes and even dangerous operating conditions. For example, if an undesirable object or item is included in the load of clothes, damage to the clothes or the appliance may result during normal operation. In addition, improper cycle settings for a particular type of load, such as hot water for a load of delicate items, can result in ruined clothing. Moreover, operation of laundry appliances by children or unauthorized users may result in safety hazards.

Accordingly, a laundry system with features for improved safety and performance of operating cycles would be desirable. More specifically, a laundry system that includes a system and method for monitoring and adjusting operation of the laundry appliance remotely would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a laundry appliance is provided, including a tub positioned within a cabinet, a basket rotatably mounted within the tub and defining a chamber configured for receiving of a load of clothes, a camera assembly mounted within the cabinet in view of the chamber, and a controller operably coupled to the camera assembly. The controller is configured to determine that a limited access mode is activated, receive a start command to commence an operating cycle of the laundry appliance, obtain one or more images of the chamber using the camera assembly, transmit the one or more images to a remote device, receive user input from the remote device, and implement a responsive action based at least in part on the user input.

In another exemplary embodiment, a method of operating a laundry appliance is provided. The laundry appliance includes a basket rotatably mounted within a tub and defining a chamber configured for receiving of a load of clothes, and a camera assembly mounted within the cabinet in view of the chamber. The method includes determining that a limited access mode is activated, receiving a start command to commence an operating cycle of the laundry appliance, obtaining one or more images of the chamber using the camera assembly, transmitting the one or more images to a remote device, receiving user input from the remote device; and implementing a responsive action based at least in part on the user input.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
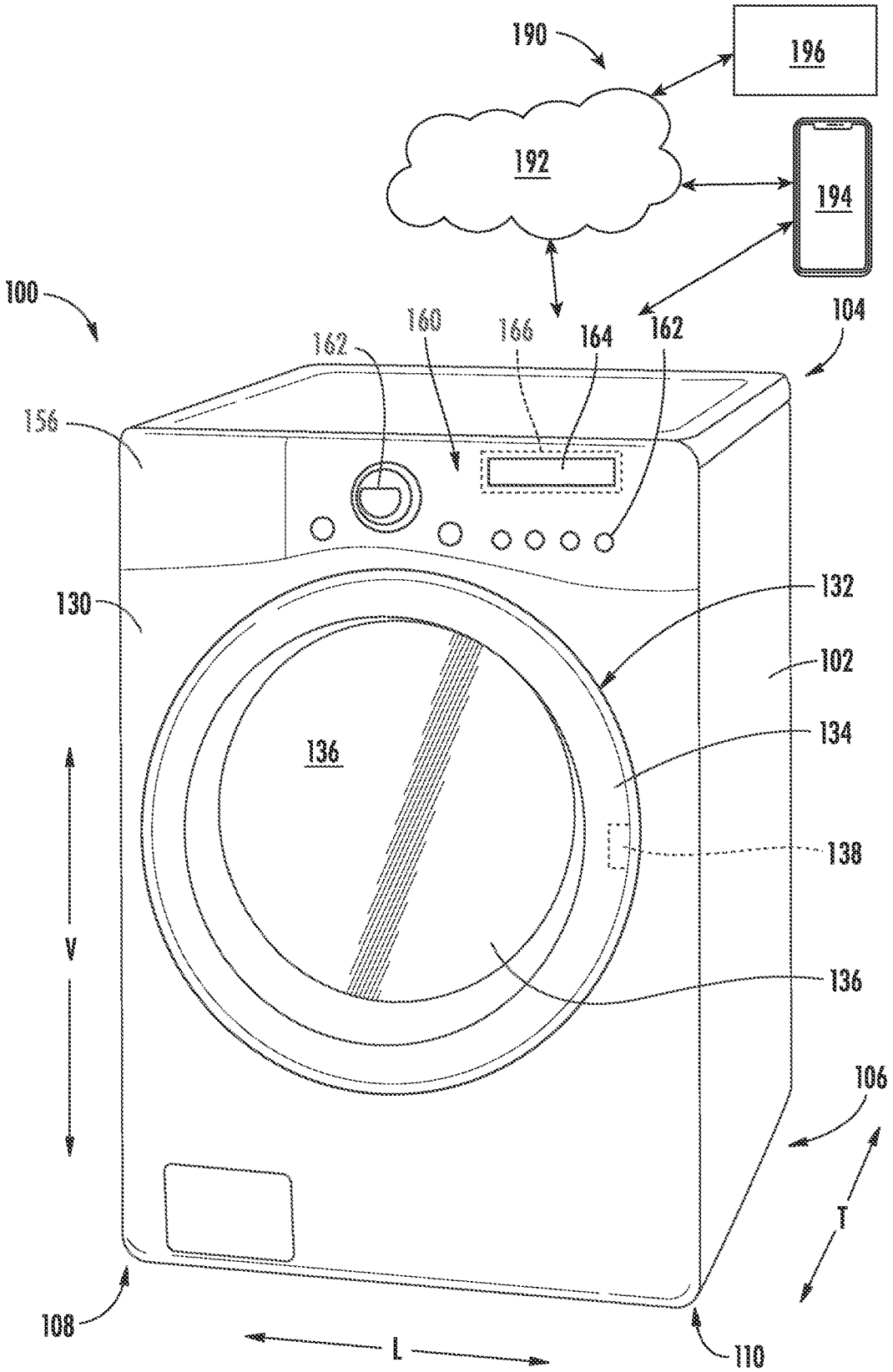
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
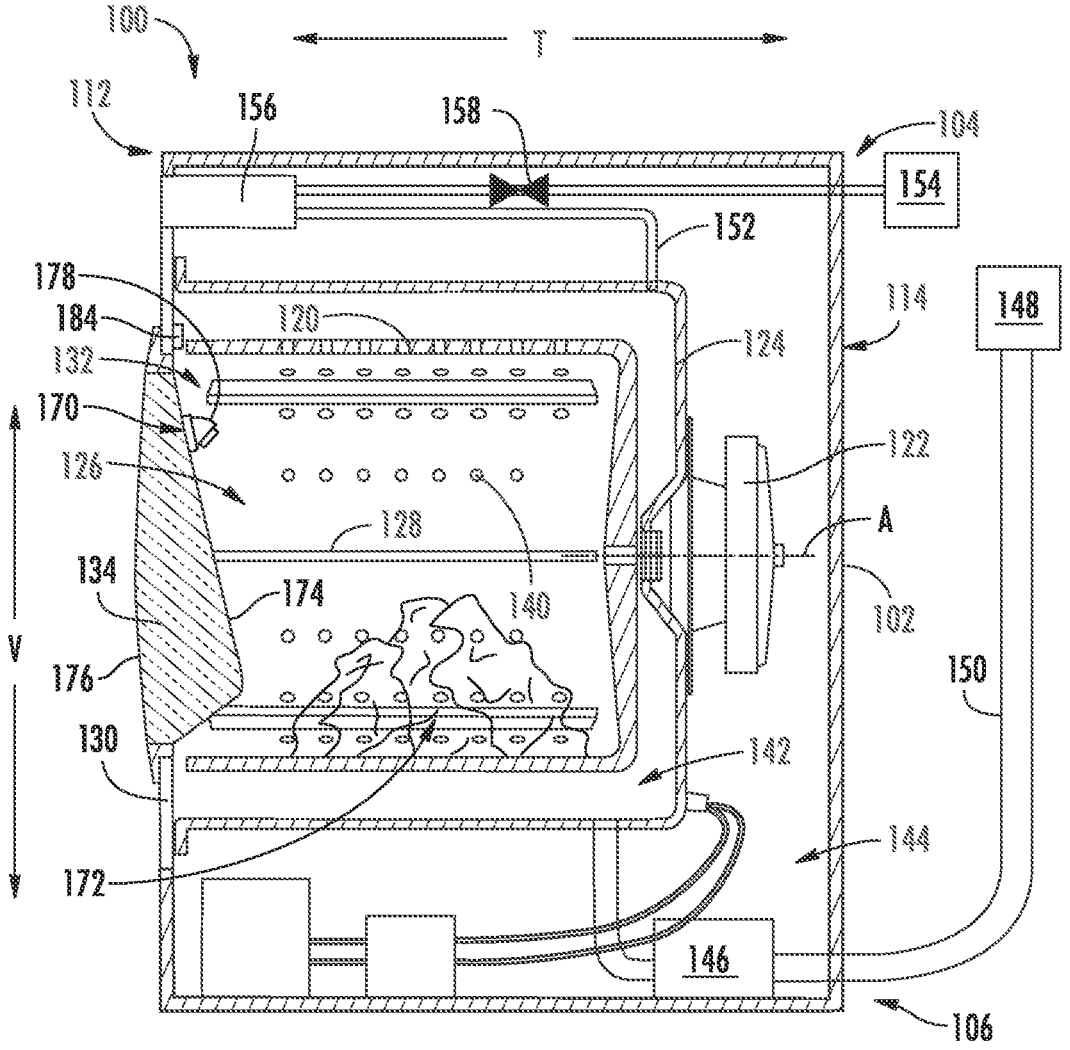
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Referring briefly to FIG. 1, door 134 may further include a latching assembly or door lock 138 that may be selectively actuated or engaged to lock door 134 in the closed position.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users. Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

Figure 3:
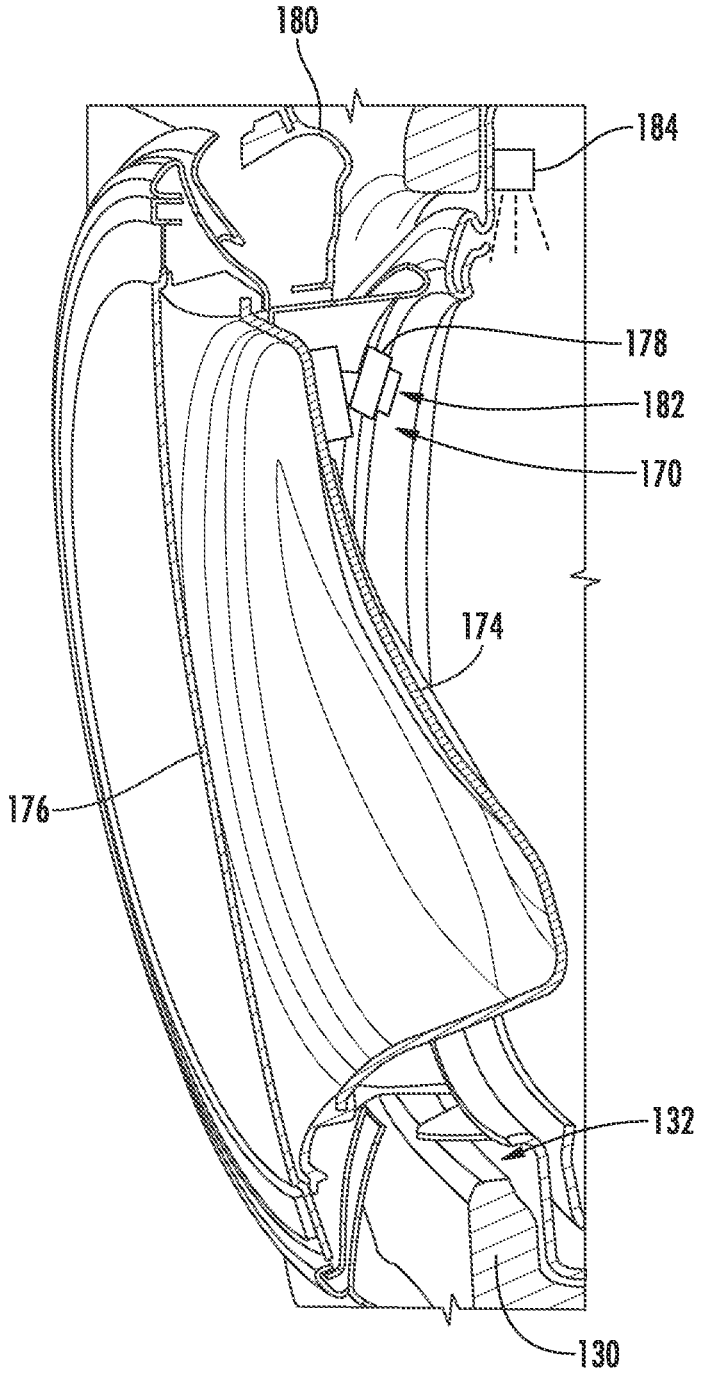
FIG. 3 provides a cross-sectional view of the exemplary washing machine appliance of FIG. 1 with a camera assembly mounted on a door according to an exemplary embodiment of the present subject matter.

Referring now specifically to FIGS. 2 and 3, washing machine appliance 100 may further include a camera assembly 170 that is generally positioned and configured for obtaining images of a load of clothes (e.g., as identified schematically by reference numeral 172) within wash chamber 126 of washing machine appliance 100. Specifically, according to the illustrated embodiment, door 134 of washing machine appliance 100 comprises and inner window 174 that partially defines wash chamber 126 and an outer window 176 that is exposed to the ambient environment. According to the illustrated exemplary embodiment, camera assembly 170 includes a camera 178 that is mounted to inner window 174. Specifically, camera 178 is mounted such that is faces toward a bottom side of wash tub 124. In this manner, camera 178 can take images or video of an inside of wash chamber 126 and remains unobstructed by windows that may obscure or distort such images.

Figure 4:
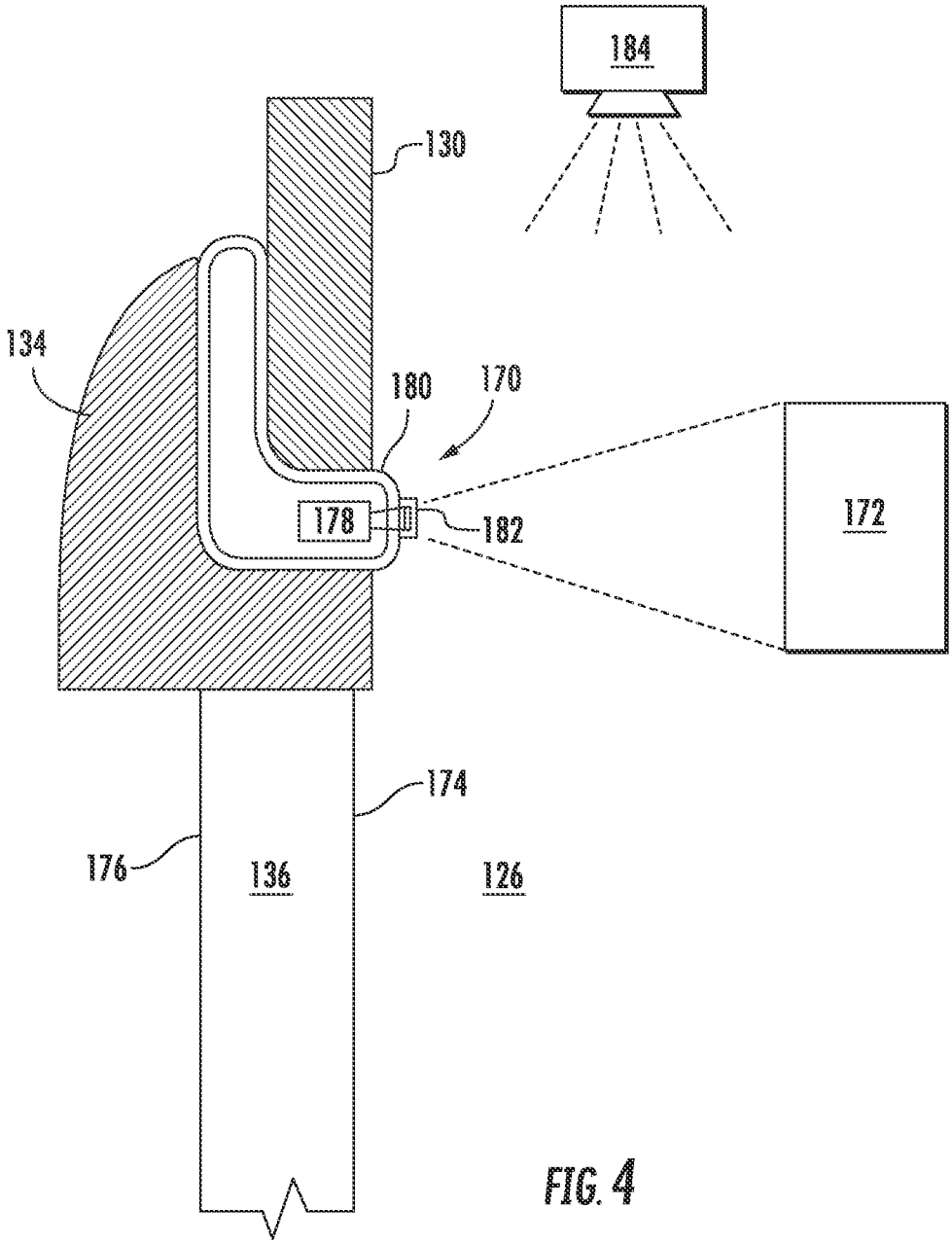
FIG. 4 provides a schematic view of a door and gasket sealed against a cabinet of the exemplary washing machine of FIG. 1, along with a camera mounted within the gasket according to an exemplary embodiment of the present subject matter.

Referring now briefly to FIG. 4, another installation of camera assembly 170 will be described according to an exemplary embodiment of the present subject matter. Due to the similarity between this and other embodiments, like reference numerals may be used to refer to the same or similar features. According to this exemplary embodiment, camera assembly 170 is mounted within a gasket 180 that is positioned between a front panel 130 of cabinet 102 and door 134. Although exemplary camera assemblies 170 are illustrated and described herein, it should be appreciated that according to alternative embodiments, washing machine appliance 100 may include any other camera or system of imaging devices for obtaining images of the load of clothes 172.

It should be appreciated that camera assembly 170 may include any suitable number, type, size, and configuration of camera(s) 178 for obtaining images of wash chamber 126. In general, cameras 178 may include a lens 182 that is constructed from a clear hydrophobic material or which may otherwise be positioned behind a hydrophobic clear lens. So positioned, camera assembly 170 may obtain one or more images or videos of clothes 172 within wash chamber 126, as described in more detail below. Referring still to FIGS. 2 through 4, washing machine appliance 100 may further include a tub light 184 that is positioned within cabinet 102 or wash chamber 126 for selectively illuminating wash chamber 126 and the load of clothes 172 positioned therein.

Notably, controller 166 of washing machine appliance 100 (or any other suitable dedicated controller) may be communicatively coupled to camera assembly 170, tub light 184, and other components of washing machine appliance 100. As explained in more detail below, controller 166 may be programmed or configured for obtaining one or images of a load of clothes within wash chamber 126, transmitting those images to a remote device (e.g., such as a user's mobile phone 194), receiving feedback from the user's remote device (e.g., as a cycle authorization or parameter adjustment), and implementing responsive action based on that user input for improved performance and safety of operation.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. In addition, aspects of the present subject matter may be utilized in a combination washer/dryer appliance. Indeed, it should be appreciated that aspects of the present subject matter may further apply to other laundry appliances, such a dryer appliance. In this regard, the same methods as systems and methods as described herein may be used to monitor a load of clothes in a chamber of the dryer.

For example, although the illustrated and described embodiment is directed toward washing machine appliance 100, which includes cabinet 102, wash tub 124, wash basket 120, and wash chamber 126, aspects of the present subject matter apply equally to a dryer appliance. In this regard, for example, cabinet 102 may be the housing of a dryer appliance, which may include a tub 124, basket 120, and chamber 126 for receiving a load of clothes 172. Detailed discussion of such a dryer appliance is omitted for brevity, but the present subject matter is intended to be equally applicable to a dryer application and the description of washing machine appliance 100 is not intended to be limiting in any manner.

Referring still to FIG. 1, a schematic diagram of an external communication system 190 will be described according to an exemplary embodiment of the present subject matter. In general, external communication system 190 is configured for permitting interaction, data transfer, and other communications between and among washing machine 100, a dryer appliance, and/or a user of such appliances. For example, this communication may be used to provide and receive operating parameters, cycle settings, performance characteristics, user preferences, or any other suitable information for improved performance of laundry system 50.

Using washing machine appliance 100 as an exemplary application, controller 166 (described in more detail below). External communication system 190 permits controller 166 of washer appliance 100 to communicate with external devices either directly or through a network 192. For example, a consumer may use a consumer device 194 to communicate directly with washing machine 100. Alternatively, these appliances may include user interfaces for receiving such input (described below). For example, consumer devices 194 may be in direct or indirect communication with washing machine 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with washing machine 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, cycle authorizations, etc. In addition, consumer device 194 and remote server 196 may communicate with washing machine 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances, or other laundry appliances such as dryer appliances. In exemplary embodiments, the various method steps as disclosed herein may be performed by controller 166 or a separate, dedicated controller.

Figure 5:
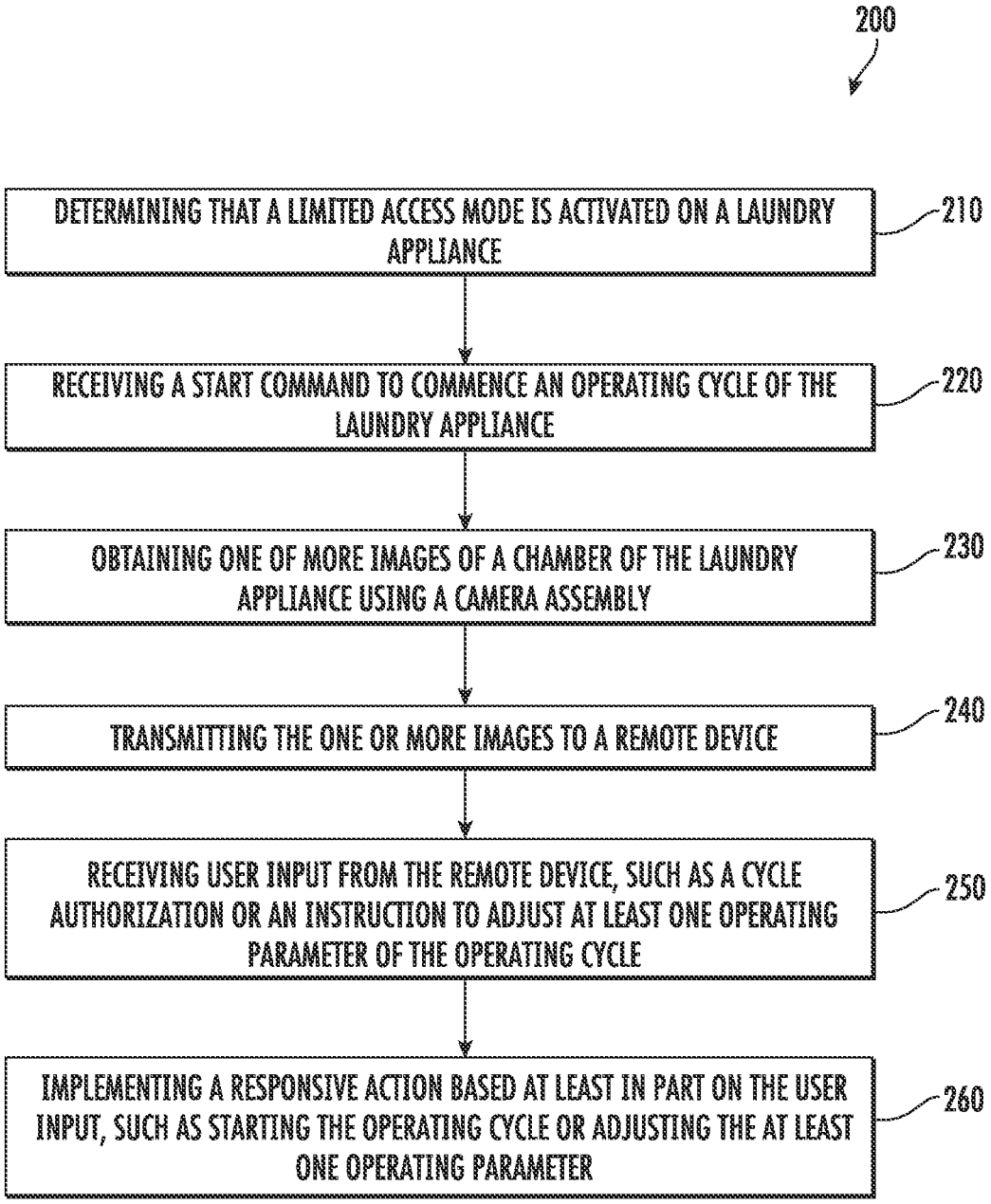
FIG. 5 illustrates a method for operating a washing machine appliance in accordance with one embodiment of the present disclosure.

Referring now to FIG. 5, method 200 includes, at step 210, determining that a limited access mode is activated on a laundry appliance. For example, using washing machine appliance 100 as an example, the limited access mode may be an optional mode of operation where certain cycle settings, operating cycles, or other performance options are not available to one or more particular users of the appliance. For example, it may be desirable to limit certain washing machine functions when a child, a person of lowered decision-making ability, or another unauthorized user intends to run a wash cycle. Aspects of the present subject matter are directed to systems and methods for restricting operation in certain conditions in order to improve overall safety and performance of the laundry appliance.

Notably, the limited access mode may be activated by a user, such as an authorized or primary user (e.g., a parent), by adjusting a setting or toggling a switch. According to other embodiments, limited access mode may be a default mode, may be active during certain hours of the day (e.g., during daytime or when a parent is working and not present at the residence), or may be programmed to be active in any other suitable particular time or during any other particular condition or event. In addition, according to exemplary embodiments, limited access mode may be activated in response to a particular user interacting with washing machine appliance 100. For example, the user of the appliance may be identified in any suitable manner, such as a biometric scanner, a camera assembly, a user access code, or through a user selection menu. In this regard, for example, controller 166 may be programmed for detecting that a child or unauthorized user is interacting with washing machine appliance 100 and may enter limited access mode. In this regard, for example, controller 166 may determine that the start command to commence an operating cycle was received from a child in may restrict operating parameters as programmed by the parent.

Controller 166 may detect or determine whether limited access mode is activated or deactivated and may adjust operation of washing machine appliance 100 accordingly. In this regard, for example, a user of the appliance may place a load of clothes within wash chamber 126, add detergent or other wash additives, adjust cycle parameters, and may attempt to start the operating cycle. In this regard, step 220 includes receiving a start command to commence an operating cycle of a laundry appliance. For example, the start command may be received from a user via control panel 160 and may include all necessary information to initiate an operating cycle of the appliance.

Notably, when the start command is received, the next step performed by washing machine appliance 100 may depend on whether limited access mode is activated. For example, if limited access mode is activated, the start command acts as an arming feature, such that door 134 may be locked (e.g. using door lock 138) and cycle authorization or adjustment may be requested from an authorized user or parent, as explained in more detail below. In addition, depending on user settings, an authorized user or parent may override the limited access mode, e.g., by establishing their identity as an authorized user via passcode, biometric scanner, or in any other suitable manner. Thus, according to an exemplary embodiment, even when limited access mode is activated, controller 166 may determine that the start command was received from an adult or another authorized user and may start the operating cycle in response to receiving the start command. Notably, when the limited access mode is not activated, controller 166 may simply start the operating cycle in response to receiving the start command, e.g., without attempting to identify the age or permission level of the user of the appliance.

Step 230 includes obtaining one or more images of a chamber of a laundry appliance using a camera assembly. In this regard, continuing example from above, camera assembly 170 of washing machine appliance 100 may obtain one or more still images, a video clip, or a live stream from within wash chamber 126. It should be appreciated that the images obtained by camera assembly 170 may vary in number, frequency, angle, resolution, detail, etc. For example, aspects of the present subject matter may be performed using a single image. By contrast, aspects of the present subject matter may also be performed using a plurality of images taken from different angles, at different times or frequencies. Moreover, these images may be taken while the wash basket 120 is stationary or rotating or may be taken periodically after tumbling wash basket 120.

For example, in order to provide an authorized user with a complete picture of what items are located within wash chamber 126, the authorized user may request that the wash basket 120 be rotated to tumble the load of clothes provide different views of the load of clothes contained therein. For example, the authorized user may press a button in a software application on the mobile phone 194 to tumble the load of clothes and provide another view within wash chamber 126. The user may be provided with one or more images, a live stream, or any suitable combination thereof. In addition, according to exemplary embodiments, controller 166 may be configured for illuminating the tub using tub light 184 just prior to obtaining images.

Step 240 includes transmitting the one or more images to a remote device. As explained briefly above, this remote device may be associated or controlled by an authorized user, e.g., a parent of a child attempting to start an operating cycle. In this regard, the remote device may be mobile phone 194 of the parent. According to exemplary embodiments, the purpose of transmitting the images obtained at step 230 is to permit the parent or authorized user to review the cycle settings, load characteristics, etc. and either permit the commencement of an operating cycle, cancel the operating cycle, make certain operating parameter adjustments, or control the operating cycle in any other suitable manner.

In other words, step 250 includes receiving user input from the remote device. This user input may be a cycle authorization or an instruction to adjust at least one operating parameter of the operating cycle. According to exemplary embodiments, this user input is provided from an authorized user or parent, e.g., via software application installed on the parent's mobile phone 194. Step 260 includes implementing a responsive action based at least in part on the user input. In this regard, for example, the parent may approve of the load characteristics and cycle parameters entered by the child at washing machine appliance 100. After reviewing these characteristics and parameters, the parent may provide the user input, which may be a cycle authorization. As a result, the responsive action implemented at step 260 may be starting the operating cycle in response to receiving the cycle authorization.

By contrast, the parent or authorized user may wish to change one or more operating parameters or cancel the operating cycle altogether. In this regard, the user input may include an instruction to adjust at least one operating parameter of the operating cycle and the responsive action implemented at step 260 may include starting the operating cycle after adjusting the at least one operating parameter. As used herein, an "operating parameter" of washing machine appliance 100 is any cycle setting, operating time, component setting, spin speed, part configuration, water level, water temperature, detergent volume, or other operating characteristic that may affect the performance or safety of washing machine appliance 100. Thus, references to operating parameter adjustments or "adjusting at least one operating parameter" are intended to refer to control actions intended to improve system performance or safety of the washing machine appliance. For example, the at least one operating parameter may include at least one of limiting a water temperature or level, limiting a chamber temperature, restricting a cycle type, limiting a spin speed, or any other operating parameter adjustments that improve the performance of an operating cycle or the safety of operation of washing machine appliance 100. In addition, the adjustment to the operating cycle may include causing the operating cycle or canceling the operating cycle. Other operating parameter adjustments are possible and within the scope of the present subject matter.

According to exemplary embodiments, the user input may be a command to permit operation of washing machine appliance 100 with specified and adjustable operating parameters for a specified period of time. In this regard, if a child is attempting to run several consecutive loads of laundry, the parent may receive a notification, adjust one or more cycle options (e.g., normal cycle, cold water, and medium spin speed), and grant access to run that specific cycle and unlimited number of times with a time period, such as two hours. Thus, the child may repeat that cycle any suitable number of times within those two hours. After the two-hour time period has lapsed, further attempts to operate the washing machine appliance 100 may result in further notifications to the parent or authorized user. In addition, according to exemplary embodiments, when the door is opened for any reason after cycle authorization, the cycle may be canceled and the child may need to restart the procedure (e.g., reenter operating cycle parameters, lock door, and seek cycle authorization from the parent).

Figure 6:
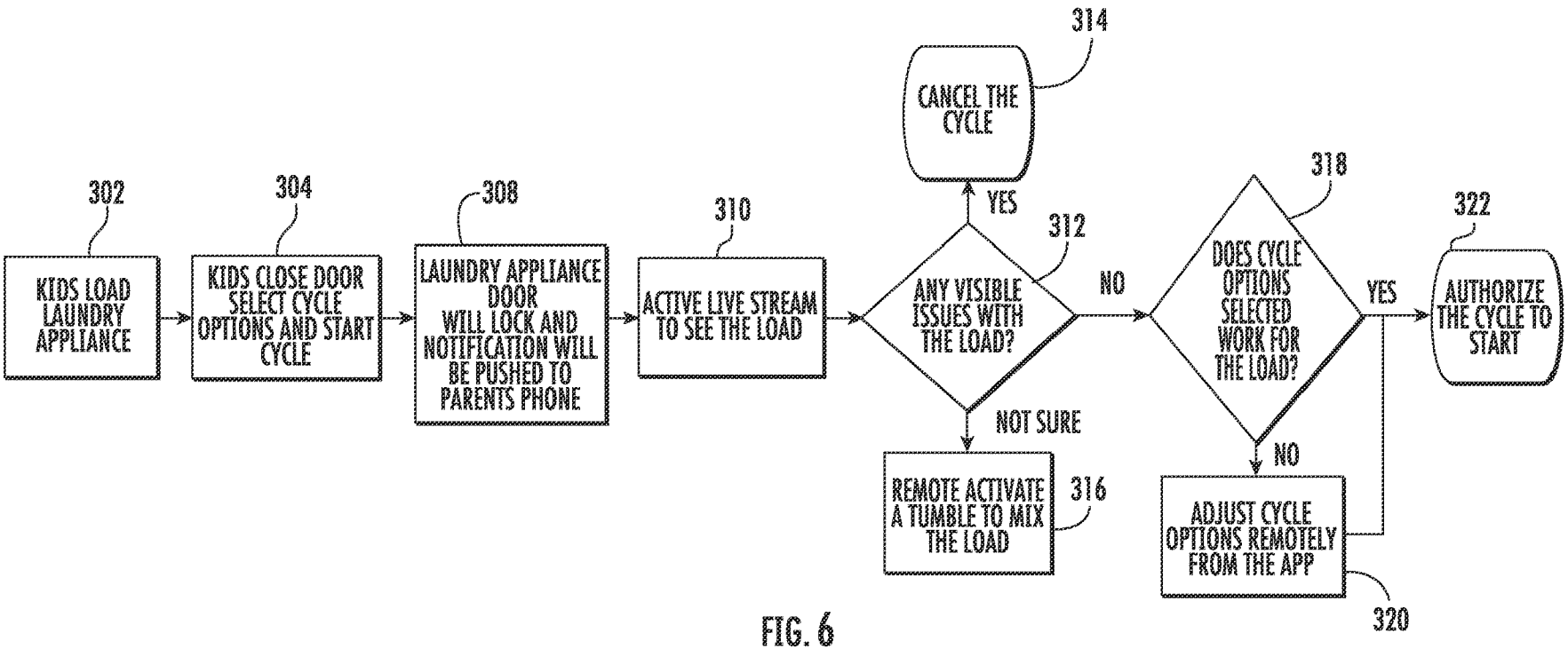
FIG. 6 illustrates a flow diagram for implementation of the exemplary method of FIG. 5 according to an exemplary embodiment of the present subject matter.

Referring now briefly to FIG. 6, one exemplary flow chart 300 illustrating the operation of washing machine appliance 100 while performing method 200 is provided. As illustrated, method 300 of a laundry appliance 100 may start when a child or another unauthorized user loads a laundry appliance with a load of clothes at step 302. After the load of clothes is positioned within the chamber, the child may close the door, select operating cycle options, and push the start button to request the start of the operating cycle at step 304. Notably, when a child presses the start button in the limited access mode, this effectively arms the laundry appliance, e.g., by locking all cycle parameters and the door until authorization is received. Specifically, step 306 includes locking the laundry appliance door and transmitting a notification to an authorized user, such as a parent, via mobile phone application.

At step 308, the parent or authorized user may be presented with one or more images or a live stream of the load of clothes within the chamber. The user may have the option of tumbling the clothes, zooming in or out on the load of clothes, turning on or off the tub light, or making any other control actions for improved visibility of the load within the chamber. At step 312, the authorized user may make the decision as to whether there are any visible issues with the load of clothes. If there are issues, step 314 may include canceling the cycle. Step 316 may include remotely activating the wash basket to tumble the load. By contrast, if there are no visible issues with load step 318 may include a review of cycle options selected for the operating cycle. If the cycle options are not appropriate, the authorized user may adjust the cycle options remotely from the software application at step 320. Step 322 includes authorizing the cycle to start, with adjusted cycle parameters if preferred. Upon receiving the start authorization and adjusted operating parameters, laundry appliance may initiate the operating cycle.

FIGS. 5 and 6 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance or dryer appliance.

The systems and methods described herein provide for a laundry process exhibiting improved operation, performance, and safety. For example, this feature may user a camera assembly to live stream images or video to a parent, caretaker, or other supervisory user so that children or other auxiliary users may be more involved in the laundry process. When monitoring is activated, e.g., via a limited access mode, the laundry appliance (washer or dryer) may deactivate the ability to start the washer or dryer without the approval of the parents to ensure that cycle parameters are set for the best washing or drying results, and properly train kids to do laundry. Kids can load the unit and make desired cycle selections, after which pressing the start button will arm the unit for remote start. The appliance can lock the door and send a notification to the parent's phone, along with a live stream of the chamber, the selected parameters, and other useful information. Parents can take advantage of live streaming and the ability to remote tumble to thoroughly check the load, make some cycle adjustments if needed, and then authorize the start of the cycle if they see no issues.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance comprising:
- a tub positioned within a cabinet;
- a basket rotatably mounted within the tub and defining a chamber configured for receiving of a load of clothes;
- a camera assembly mounted within the cabinet in view of the chamber; and
- a controller operably coupled to the camera assembly, the controller being configured to:
  - determine that a limited access mode is activated;
  - receive a start command to commence an operating cycle of the laundry appliance;
  - obtain one or more images of the chamber using the camera assembly, wherein the one or more images comprises a live stream from within the chamber of the laundry appliance;
  - transmit the one or more images to a remote device;
  - receive user input from the remote device; and
  - implement a responsive action based at least in part on the user input.

2. The laundry appliance of claim 1, wherein determining that the limited access mode is activated comprises:
- determining that the start command was received from a child.

3. The laundry appliance of claim 1, wherein the controller is further configured to:
- determine that the start command was received from an adult; and
- start the operating cycle in response to receiving the start command.

4. The laundry appliance of claim 1, wherein the limited access mode is toggled by a user of the washing machine appliance.

5. The laundry appliance of claim 1, wherein the controller is further configured to:
- determine that the limited access mode is not activated; and
- start the operating cycle in response to receiving the start command.

6. The laundry appliance of claim 1, further comprising:
- a door rotatably mounted to the cabinet for providing selective access to the chamber; and
- a door lock for selectively locking the door, wherein the controller is operably coupled to the door lock and is configured to lock the door upon receiving the start command.

7. The laundry appliance of claim 1, wherein the remote device is a mobile phone of an authorized user or a parent of a child who provided the start command.

8. The laundry appliance of claim 1, wherein the user input comprises a cycle authorization, and wherein implementing the responsive action comprises:
- starting the operating cycle in response to receiving the cycle authorization.

9. The laundry appliance of claim 1, wherein the user input comprises an instruction to adjust at least one operating parameter of the operating cycle, and wherein implementing the responsive action comprises:
- starting the operating cycle after adjusting the at least one operating parameter.

10. The laundry appliance of claim 9, wherein adjusting the at least one operating parameter comprises at least one of limiting a water temperature or level, limiting a chamber temperature, restricting a cycle type, or limiting a spin speed.

11. The laundry appliance of claim 1, further comprising:

a tub light for illuminating the chamber, wherein the controller is further configured to turn on the tub light prior to obtaining the one or more images of the chamber.

12. The laundry appliance of claim 1, wherein the laundry appliance is a washing machine appliance or a dryer appliance.

13. The laundry appliance of claim 1, wherein the controller is further configured to:

receive a command to tumble the load of clothes in the chamber;

rotate the basket to tumble the load of clothes;

obtain one or more additional images of the chamber using the camera assembly;

transmit the one or more additional images to the remote device.

14. A method of operating a laundry appliance, the laundry appliance comprising a basket rotatably mounted within a tub and defining a chamber configured for receiving of a load of clothes, and a camera assembly mounted within the cabinet in view of the chamber, the method comprising:

determining that a limited access mode is activated;

receiving a start command to commence an operating cycle of the laundry appliance;

obtaining one or more images of the chamber using the camera assembly, wherein the one or more images comprises a live stream from within the chamber of the laundry appliance;

transmitting the one or more images to a remote device;

receiving user input from the remote device; and implementing a responsive action based at least in part on the user input.

15. The method of claim 14, further comprising:

receiving a command to tumble the load of clothes in the chamber;

rotating the basket to tumble the load of clothes;

obtaining one or more additional images of the chamber using the camera assembly;

transmitting the one or more additional images to the remote device.

16. The method of claim 14, further comprising:

determining that the start command was received from an adult; and starting the operating cycle in response to receiving the start command.

17. The method of claim 14, wherein the limited access mode is toggled by a user of the washing machine appliance.

18. The method of claim 14, further comprising:

determining that the limited access mode is not activated; and starting the operating cycle in response to receiving the start command.

19. The method of claim 14, wherein the user input comprises a cycle authorization, and wherein implementing the responsive action comprises:

starting the operating cycle in response to receiving the cycle authorization.

20. The method of claim 14, wherein the user input comprises an instruction to adjust at least one operating parameter of the operating cycle, and wherein implementing the responsive action comprises:

starting the operating cycle after adjusting the at least one operating parameter.

* * * * *